US008434173B1

(12) United States Patent
Drew

(10) Patent No.: US 8,434,173 B1
(45) Date of Patent: May 7, 2013

(54) DIAPER CLEANING DEVICE

(76) Inventor: Bernadette D. Drew, Abingdon, MD (US)

( * ) Notice: Subject to any disclaimer, the term of this patent is extended or adjusted under 35 U.S.C. 154(b) by 414 days.

(21) Appl. No.: 12/839,188

(22) Filed: Jul. 19, 2010

(51) Int. Cl.
*E03D 9/00* (2006.01)

(52) U.S. Cl.
USPC ..... 4/666; 68/235 D; 68/223; 68/225

(58) Field of Classification Search ..... 4/666, 661; 68/235 D, 223, 225–226, 228, 240, 14
See application file for complete search history.

(56) References Cited

U.S. PATENT DOCUMENTS 1,239,176 A 9/1917 Gilbert
1,783,147 A * 11/1930 Barnard ..... 68/235 D
2,473,852 A 6/1949 Berry
2,882,708 A * 4/1959 Hancock et al. ..... 68/235 D
2,928,270 A 3/1960 Olson
3,018,488 A * 1/1962 Snead ..... 4/666
3,308,640 A 3/1967 Russey
3,611,758 A 10/1971 Miller et al.
3,860,971 A 1/1975 Dirks
5,050,408 A 9/1991 Toupin et al.

OTHER PUBLICATIONS

The Fast and Easy Way to Rinse Cloth Diapers. The Potty Pail—Cloth Diaper Sprayer—Toilet Sprayer Hose and Rinsing System. http://www.pottypail.com/ Accessed Jul. 20, 2009.

* cited by examiner

*Primary Examiner* — Gregory Huson
*Assistant Examiner* — Janie Christiansen
(74) *Attorney, Agent, or Firm* — Montgomery Patent & Design; Robert C. Montgomery

(57) ABSTRACT

A device for assisting in the cleaning of reusable cloth diapers comprises a molded plastic frame which rests on an interior perimeter of a toilet bowl. The frame comprises a universal design such that it fits on both round and oval bowls. A plurality of adjustable spring clips holds and supports the soiled diaper in a taut and stretched configuration. With the device and diaper in place, the diaper may be rinsed off. When finished, the toilet is flushed and the device is removed, folded, and stored in a supplied storage case.

9 Claims, 10 Drawing Sheets

DIAPER CLEANING DEVICE

RELATED APPLICATIONS

The present invention was first described in a notarized Official Record of Invention on Jun. 9, 2009, that is on file at the offices of Montgomery Patent and Design, LLC, the entire disclosures of which are incorporated herein by reference.

FIELD OF THE INVENTION

The present invention relates generally to diaper cleaning devices, and more particularly, to a device for assisting in the cleaning of reusable cloth diapers comprising a molded plastic frame which rests on an interior perimeter of a toilet bowl.

BACKGROUND OF THE INVENTION

Many parents have recently turned away from the use of disposable diapers and have returned to the use of cloth diapers. Aside from the huge environmental impact disposable diapers make in our landfills, there are many other reasons for the use of cloth diapers. These include lower overall cost, cooler to wear in hot weather, and better care of sensitive skin on the child. However, the primary difficulty associated with the use of cloth diapers is the necessity to pre-clean them to remove solid waste before washing the diaper in a tub by hand or in a washing machine. Many parents and care providers use a diaper sprayer, which attaches to the incoming water line on a toilet and allows the user to rinse solids off of the diaper and right into the toilet bowl for flushing. Unfortunately, this process can be overbearing and cumbersome, seemingly requiring the use of three hands to clean the diaper given the need to hold the diaper in a spread and taut position and utilize the sprayer. This problem is even more pronounced with diapers that have sewn-in elastic which needs to be stretched out for proper cleaning. Additionally, the spray from the diaper sprayer often misses or over sprays the diaper causing a mess which must be cleaned up after each use.

Various attempts have been made to solve the problems associated with cleaning reusable cloth diapers. One (1) example of these solutions provides a planar cleaning surface which mount to a toilet and a hand held scraper, as seen in U.S. Pat. No. 1,239,176, issued in the name of Gilbert. Other solutions include devices which provide slots or rollers intended to ring out the soiled diaper. Examples of these devices can be seen in U.S. Pat. No. 2,473,852, issued in the name of Berry; U.S. Pat. No. 2,928,270, issued in the name of Olson; U.S. Pat. No. 3,611,758, issued in the name of Miller et al.; and U.S. Pat. No. 5,050,408, issued in the name of Toupin et al.

Another solution includes a net holder which is suspended within a toilet to hold a soiled diaper for washing, as can be seen by example in U.S. Pat. No. 3,860,971, issued in the name of Dirks. Still another solution includes an open face shell which is supported by the rim of a toilet having a hanger from which a soiled diaper is suspended for washing, as can be seen by example in U.S. Pat. No. 3,308,640.

While these devices may accomplish their specific intended purpose, each suffers from one (1) or more disadvantage or deficiency with respect to design, function, or effectiveness. Accordingly, there exists a need for a means by which cloth diapers can be pre-cleaned in a toilet without the disadvantages as described above. The development of the present invention substantially departs from the conventional solutions and in doing so fulfills this need.

SUMMARY OF THE INVENTION

In view of the current lack and inherent problems in the art, the inventor has recognized the need for a novel device for washing or otherwise pre-cleaning a soiled reusable cloth diaper and thus, the object of the present invention is to solve the aforementioned disadvantages and provide for this need.

Another object of the present invention is to provide a device which enables the user to easily remove solid waste matter from the diaper and conveniently dispose of the waste with a toilet.

Another object of the present invention is to provide a device which securely retains the diaper in an open and spread position for effective cleaning.

Another object of the present invention is to provide a device which prevents overspray from contacting other bathroom surfaces.

Yet another object of the present invention is to provide a device which effectively mounts to the rim of the toilet during use.

Yet another object of the present invention is to provide a device which is adapted for use with toilets of various sizes, shapes, and makes.

Yet another object of the present invention is to provide a device which is collapsible for convenient storage upon a support base.

Yet another object of the present invention is to provide a device which enables the user to use both hands for cleaning the soiled diaper.

Yet another object of the present invention is to provide a device which is simple and intuitive to use with little to no training.

Yet another object of the present invention is to provide a device which is durable and economical to manufacture.

One (1) or more of these and other objects of the invention are achieved by providing a diaper cleaning device comprising a generally flat base panel for supporting a soiled diaper in a generally vertical and outstretched configuration. The base panel including an upper edge portion, a lower edge portion, and a first side edge portion, and an opposing second side edge portion. A plurality of spring clips are provided and attached to the base panel for securing the soiled diaper in said configuration. A curved first side panel including a first hinged end is hingedly attached to the base panel first side edge portion for shielding an over spray of water and a curved second side panel including a second hinged end is hingedly attached to the base panel second side edge portion also for shielding the over spray of water. A semi-circular lid is provided and hingedly attached to the base panel upper edge portion. A generally flat bottom panel is provided and perpendicularly affixed to the base panel lower edge portion and a semi-circular lower portion is affixed to a lower end of the base panel and a perimeter of the bottom panel to define a receptacle for collecting an amount of waste water. A funnel is disposed at an intermediate location on the bottom panel for channeling the waste water into a toilet. A pair of footings are also provided and adjustably attached to a bottom surface of the bottom panel for bracing the device to a toilet rim portion. The two (2) footings each include a clamping means for clamping the footings to the toilet rim portion.

In at least one (1) embodiment of the device, the device comprises an open state and a closed state. The open state is achieved with the pair of side panels and the lid are in a hingedly open position for use of the device and the closed state is achieved when the pair of side panels and the lid are in a hingedly closed position for storage of the device.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
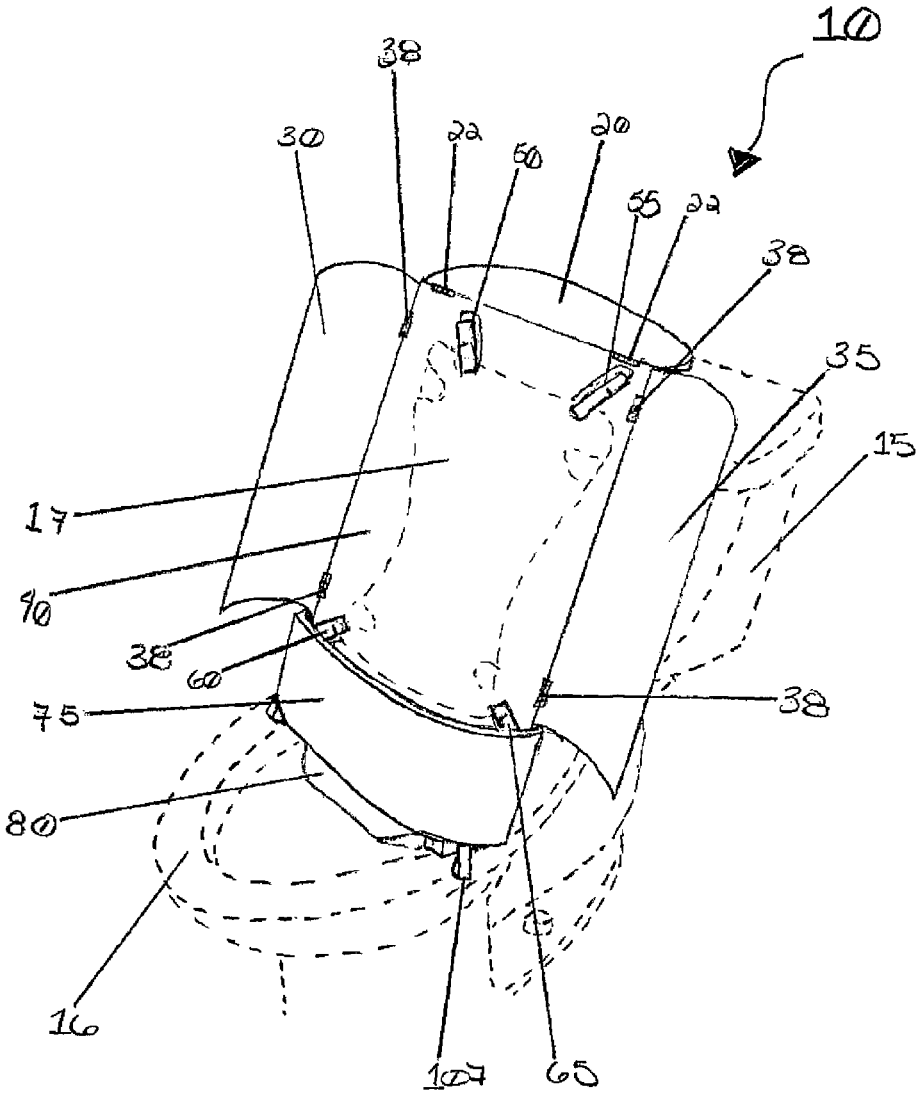
FIG. 1 is an environmental view of a cloth diaper cleaning device 10, according to a preferred embodiment of the present invention.

10 cloth diaper cleaning device
15 toilet
16 toilet rim
17 diaper
20 lid
22 lid hinge
24 handle
25 lid fastener
30 first side panel
31 first side panel handle
32 first side panel fastener
35 second side panel
36 second side panel handle
37 second side panel fastener
38 panel hinge
40 base panel
50 first upper clip
51 first upper groove
55 second upper clip
56 second upper groove
57 secondary channel
60 first lower clip
61 first lower groove
65 second lower clip
66 second lower groove
67 ball joint
68 clip hinge
69 first jaw
70 second jaw
71 first actuator
72 second actuator
73 clip post
75 lower portion
76 bottom panel
80 funnel portion
85 funnel opening
90 indicia
100 footing
105 anti-skid means
106 wall
107 clip
108 track
109 clip fastener
110 base
111 base footing
112 base interior
113 apertures

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a diaper cleaning device (herein described as the "device") 10, which provides a means for assisting in the cleaning of diapers 17. The device 10 is particularly suited for cleaning cloth diapers. The device 10 is preferably utilized with a common spray mechanism which attaches to a toilet 15 or a sink for spraying soiled diapers 17 previous to washing. The device 10 comprises a lid 20, a first side panel 30, a second side panel 35, a plurality of diaper 17 attachment means, a bottom panel 76, a funnel portion 80, and a base 110. In use, the device 10 is positioned on a toilet rim portion 16, thereby enabling a soiled diaper 17 to be secured and suspended on the device 10 at an inner intermediate portion 40 for initial cleaning. The device 10 is preferably fabricated from a molded plastic, yet other materials such as metal or the like and may be utilized without limiting the scope of the device 10. The device 10 may also be fabricated in a variety of colors and patterns to correspond to various décor.

Referring now to FIG. 1, an environmental view of the device 10, according to the preferred embodiment of the present invention, is disclosed. In use, the device 10 is positioned superjacent to a toilet 15 preferably on the toilet rim 16. The device 10 comprises a universal design that which may be utilized on both oval-shaped and round-shaped toilets 15. The device 10 comprises an adjustable attachment means for diapers 17, thereby enabling various sizes to be utilized thereon. When the soiled waste matter is rinsed off the diaper 17, the waste is distributed into the toilet 15 for subsequent dispensing. The device 10 is conveniently stored in a desired location after use via a base 110 (see FIG. 7).

Figure 2:
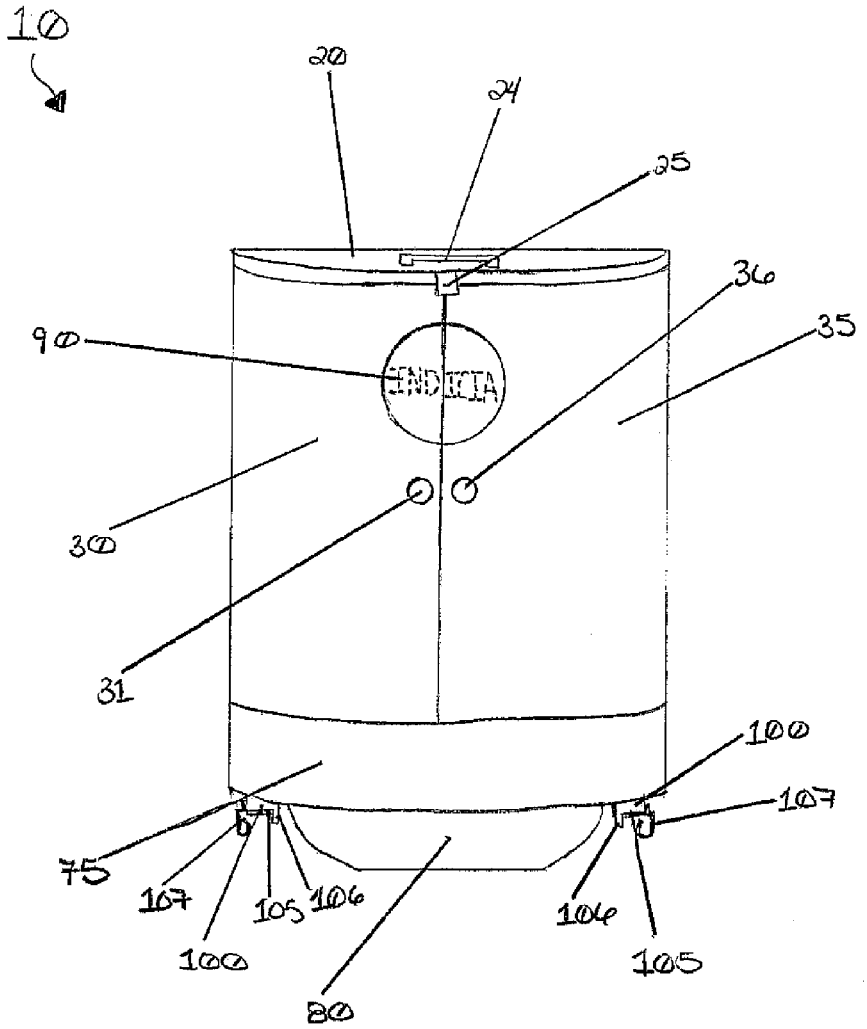
FIG. 2 is a front perspective view of the cloth diaper cleaning device 10, according to a preferred embodiment of the present invention.
Figure 3:
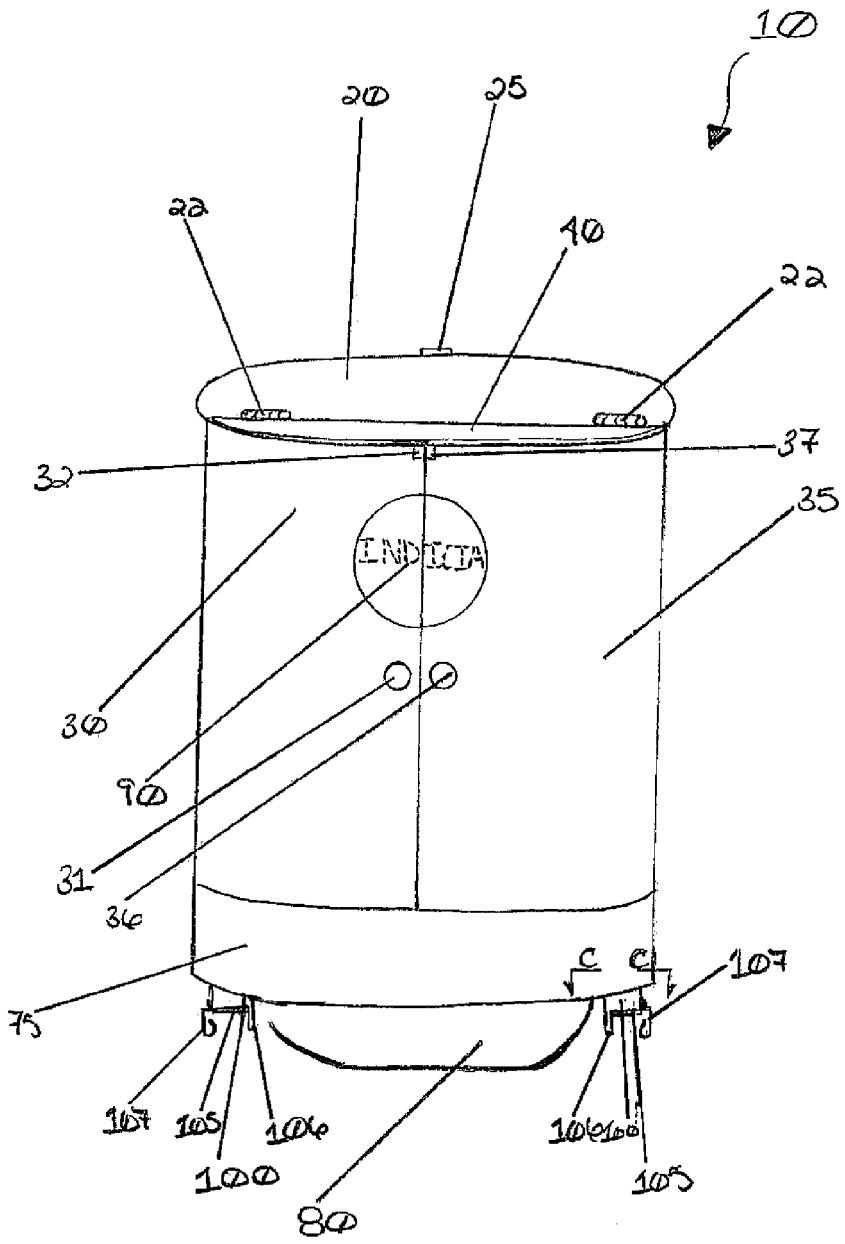
FIG. 3 is a front perspective view of the cloth diaper cleaning device 10 depicted with a lid 20 in an open state, according to a preferred embodiment of the present invention.

Referring now to FIG. 2, a front perspective view of the device 10 and FIG. 3, another front perspective of the device 10 depicting the lid 20 in an open state, according to the preferred embodiment of the present invention, are disclosed. An upper portion of the device 10 comprises a lid 20, thereby enabling the device 10 to be fastened in a closed position, unfastened in an open position, and to be transported to a desired location. The lid 20 comprises a semi-circular form and an upper horizontal surface comprises a handle 24, thereby enabling a user to grasp the handle 24 for transporting the device 10. The handle 24 comprises a "U"-shaped form which is preferably integrally molded into the lid 20, yet other attachment means may be provided such as, but not limited to: welding, adhesives, fasteners, or the like.

A front surface of the lid 20, perpendicular to the handle 24, comprises a lid fastener 25 enabling the fastening and unfastening thereof. The lid fastener 25 is preferably a magnetic fastener which engages and disengages a first side panel fastener 31 and a second side panel fastener 37, which are also preferably magnetic fasteners, yet other fastening means may be utilized without limiting the scope of the device 10. The first side panel fastener 31 and the second side panel fastener 37 are located on an upper inner portion of a first side panel 30 and a second side panel 35, respectively. In use, the handle 24 is lifted and the lid fastener 25 disengages from the side panel fasteners 32, 37 and the lid 20 pivots about a fixed axis of rotation via a pair of lid hinges 22 to an open state. The lid hinges 22 are located on inner portions of the lid 20 and connect the lid 20 to a base panel 40 (see FIG. 4).

Below the lid 20 at a front position are a first side panel 30 and a second side panel 35 which enable an internal portion of the device 10 to be accessed. A front portion of the first side panel 30 comprises a circular first side panel handle 31 and a front portion of the second side panel 35 comprises a circular second side panel handle 36, thereby enabling a user to grasp the panel handles 31, 36 and open the panels 30, 35. The panel handles 31, 36 are located at an intermediate position of each corresponding panel 30, 35 and are positioned parallel to each other. The panel handles 31, 36 are attached to the corresponding panel 30, 35 via a fastening means such as, but not limited to: integral molding, welding, fasteners, or the like.

A front portion of each panel 30, 35 also comprises a portion dedicated to indicia 90 providing script or logos based upon a user's preference and may include images such as, but not limited to, sports names and logos, personal names, symbols, pictures having a variety of colors and patterns to further customize and personalize the device 10. Although illustrated herein as being located on a front surface of each panel 30, 35, the indicia 90 may be positioned on other portions of the device 10 without limiting the scope of the device 10.

Beneath each panel 30, 35 is an arcuate lower portion 75 connecting the upper portion of the device 10 to the funnel portion 80 and creating a barrier to contain water and direct run-off into the funnel portion 80 (see FIG. 6). The lower portion 75 is integrally molded to the funnel portion 80.

Figure 4:
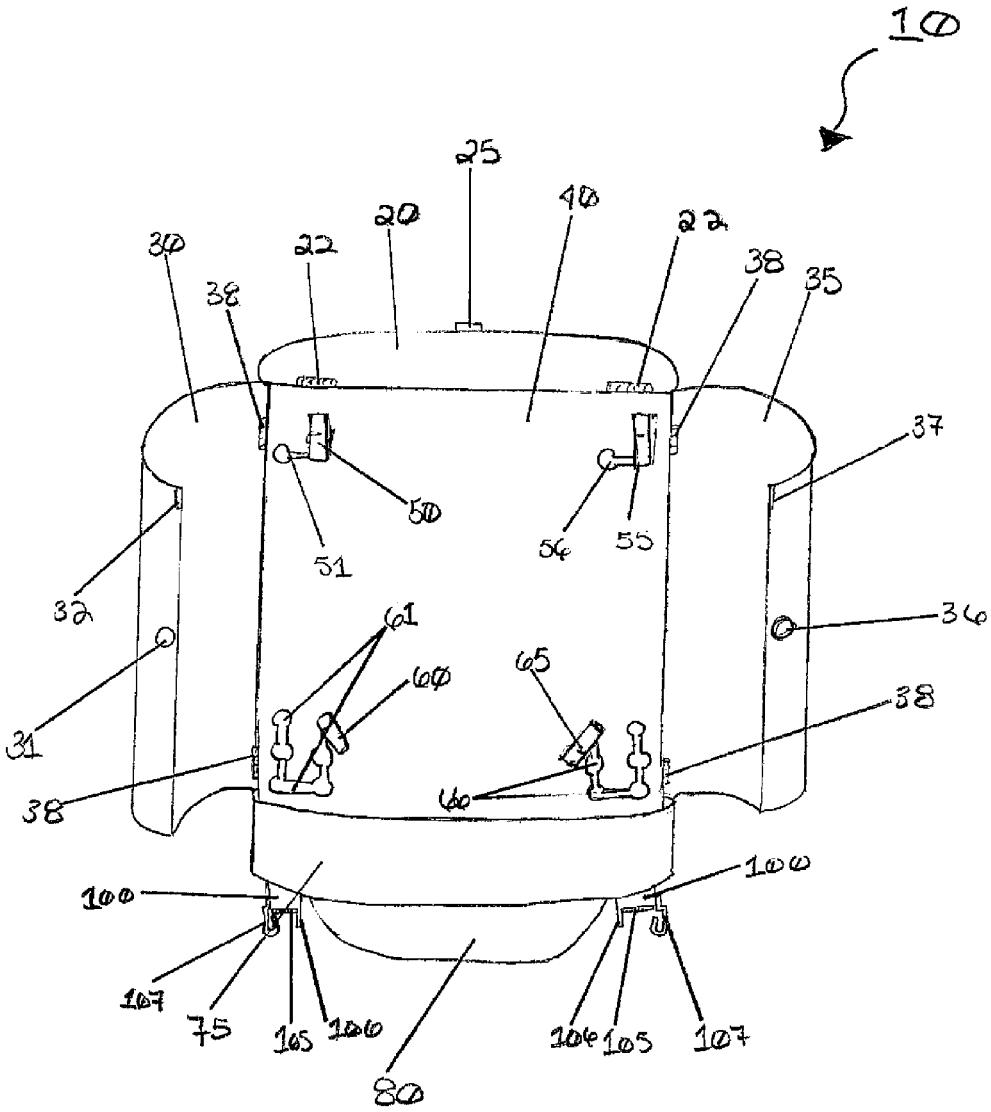
FIG. 4 is a front perspective view of the cloth diaper cleaning device 10 depicted in an open state, according to a preferred embodiment of the present invention.

Referring now to FIG. 4, another front perspective view of the device 10 depicted in an open state, according to the preferred embodiment of the present invention, is disclosed. Each panel 30, 35 comprises an arcuate shape, thereby providing a barrier to over-spray or splash-back which may occur during the cleaning process of a soiled diaper 17. In use, the panels 30, 35 are positioned in the open state by grasping and pulling the panel handles 31, 36 which rotates the panels 30, 35 outwardly via a plurality of panel hinges 38. The panel hinges 38 are located on an interior portion of the device 10 and connect each panel to the base panel 40. Each side panel 30, 35 may be in an open or closed state during cleaning as desired by the user.

With the side panels 30, 35 in the open state, a user may access the base panel 40 for attaching a diaper 17 thereto. The rectangular base panel 40 comprises a first upper groove 51, a second upper groove 56, a first lower groove 61, and a second lower groove 66 which enable a first upper clip 50, a second upper clip 55, a first lower clip 60, and a second lower clip 65 to be attached in a desired location to pull the diaper taut. Each groove 51, 56, 61, 66 comprises alternating circular and linear cut-outs which enable each clip 50, 55, 60, 65 to slidably engage the desired location. Each groove 51, 56, 61, 66 also comprises a secondary channel 57 disposed behind the groove 51, 56, 61, 66 between front and rear layers of the base panel 40; which enables the clips 50, 55, 60, 65 to be routed to a desired vertical or horizontal position in a secured manner (see FIG. 5*a*). The first upper groove 51 and the second upper groove 56 provide a horizontal positioning means to a respective first upper clip 50 and second upper clip 55 and provides an attachment means to an upper portion of the diaper 17. The upper clips 50, 55 may be positioned in one (1) of two (2) positions via sliding the upper clips 50, 55 to a desired position (also see FIG. 5). The first lower groove 61 and second lower groove 66 provide a "U"-shaped channel which provides a plurality of positions for the lower clips 60, 65 which are slid into a desired position based on the size of the diaper 17.

Figure 5A:
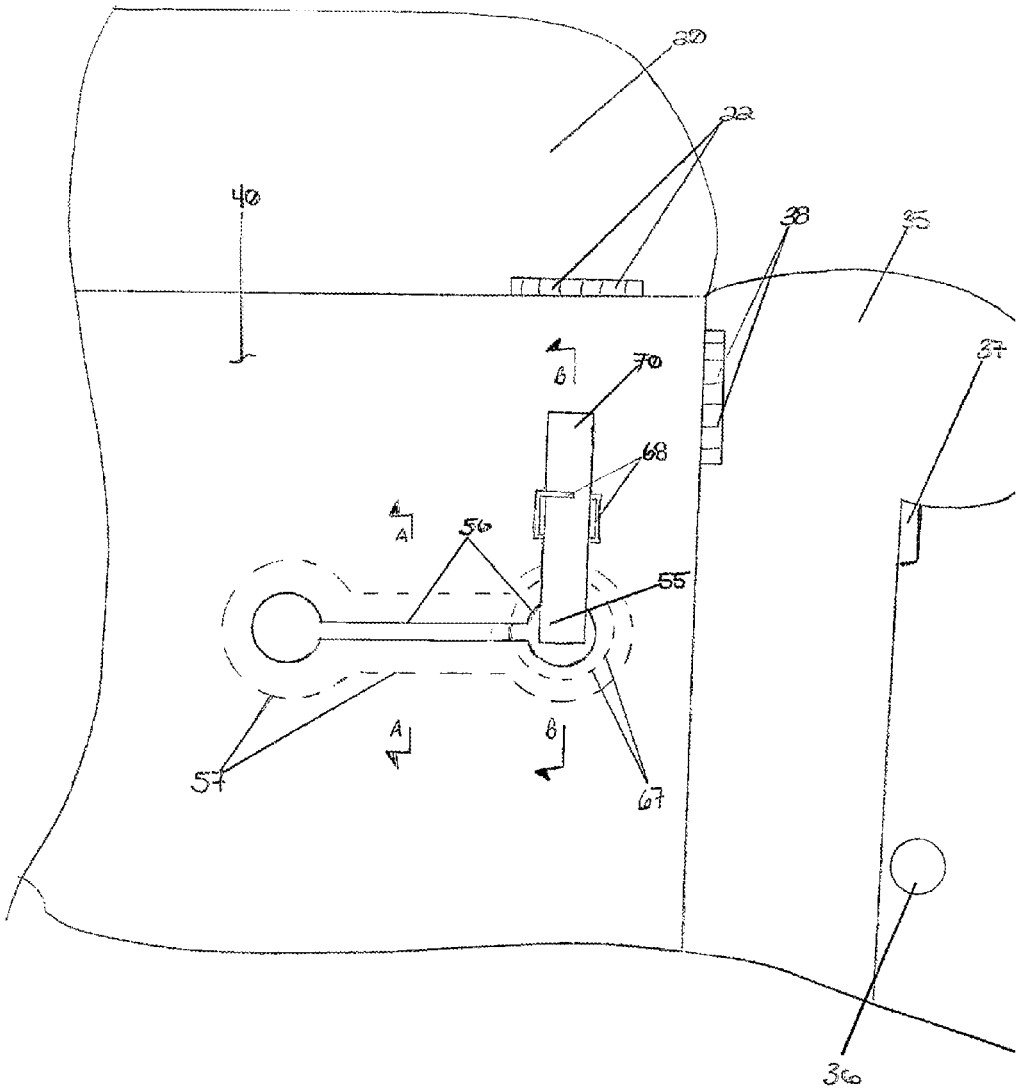
FIG. 5*a* is a close-up view of a second upper channel 56, according to a preferred embodiment of the present invention.
Figure 5B:
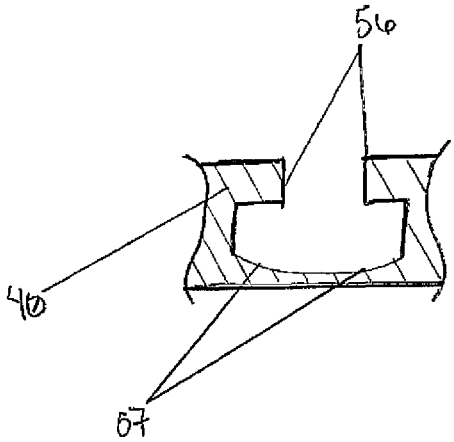
FIG. 5*b* is a section view of the second upper channel 56 taken along line A-A of FIG. 5*a*, according to a preferred embodiment of the present invention.
Figure 5C:
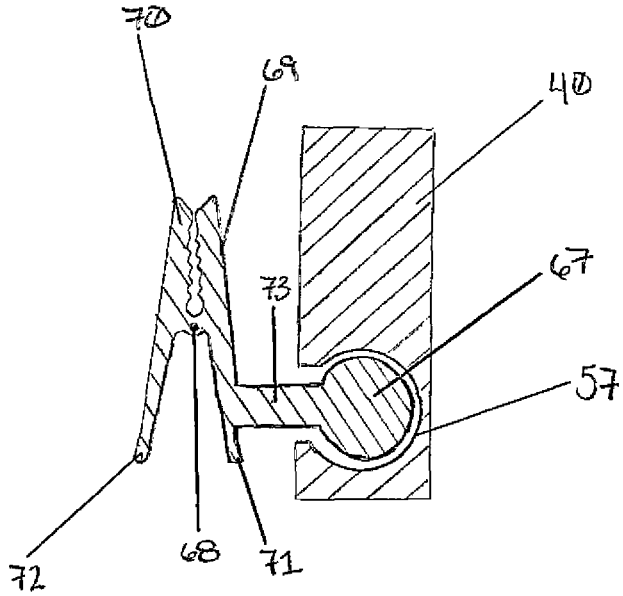
FIG. 5*c* is another section view of the second upper channel 56 taken along line B-B of FIG. 5*a*, according to a preferred embodiment of the present invention.

Referring now to FIG. 5*a*, a close-up view of a second upper groove 56, FIG. 5*b*, a section view of the second upper groove 56 taken along section line A-A of FIG. 5*a*, and FIG. 5*c*, a section view of the second upper groove 56 taken along section line B-B of FIG. 5*a*, according to a preferred embodiment of the present invention, are disclosed. FIGS. 5*a* through 5*c* depict various views of a second upper clip 55 and a second upper groove 56 for illustration purposes only, it is known that the same features depicted herein may be applied to each groove 51, 56, 61, 66 and each clip 50, 55, 60, 65 without limiting the scope of the device 10. Each of the clips 50, 55, 60, 65 comprises a conventional spring-actuated fastening means having a clip hinge 68, a first jaw 69, a second jaw 70, a first actuator 71, a second actuator 72, and a clip post 73 and are fabricated from materials such as, but not limited to: plastic, metal, wood, or the like. The second actuator 72 is depressed inwardly toward the first actuator 71 to pivot the clip hinge 68 and concurrently open the first jaw 69 and second jaw 70 for positioning of the diaper 17 between the jaws 69, 70. The jaws 69, 70 close down on the diaper 17 via releasing the second actuator 72. This means of fastening the diaper 17 to a clip 50, 55, 60, 65 is repeated until the diaper is secured within all the clips 50, 55, 60, 65. A rear surface of the first actuator 71 on each clip 50, 55, 60, 65 comprises the integrally molded clip post 73 which further comprises an integrally molded ball joint 67. The post clip 73 protrudes from the respective groove 51, 56, 61, 66 and the ball joint 67 sets within the secondary channel 57. The secondary channel 57 is slightly offset from each groove 51, 56, 61, 66 to enable the ball joint 67 to travel within the secondary channel 57. The user grasps the clip 50, 55, 60, 65 and slidably engages the ball joint 67 into a desired secondary channel 57 position. The ball joint 67 may engage with a circular portion of the secondary channel 57 to enable the clip 50, 55, 60, 65 to rotate to a desired orientation which positions the jaws 69, 70 parallel to the diaper 17.

Figure 6A:
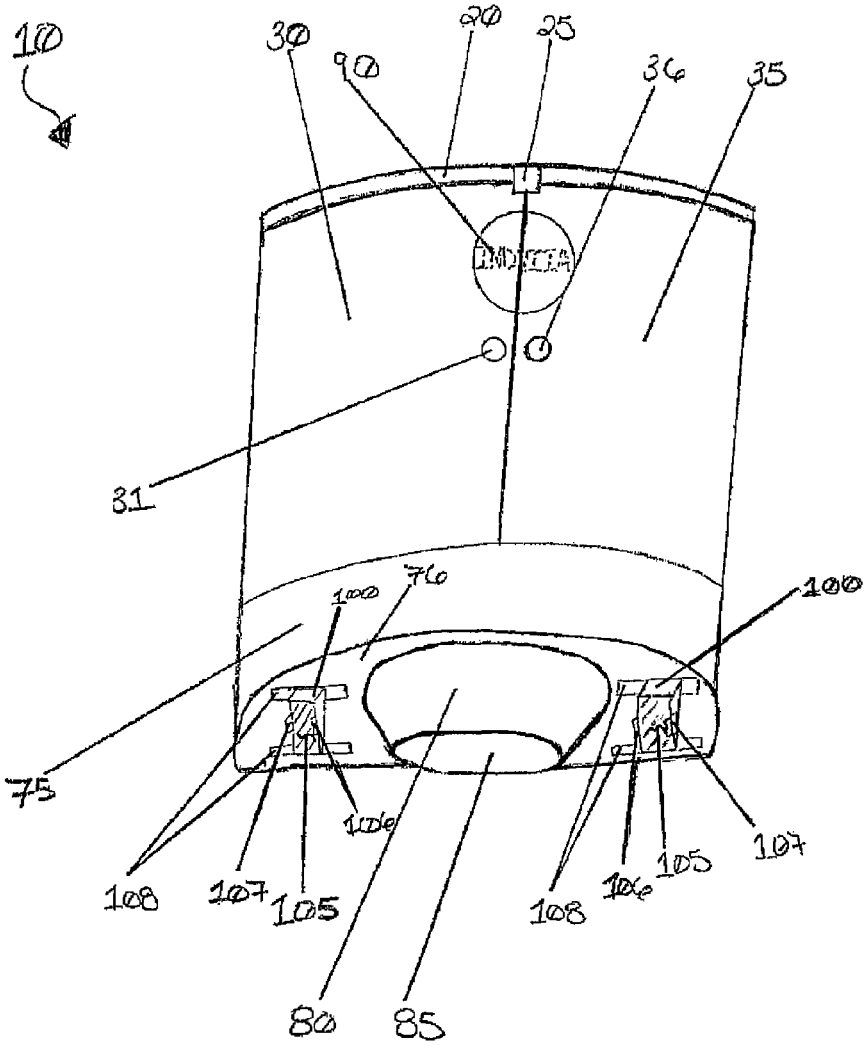
FIG. 6*a* is a rear perspective view of the cloth diaper cleaning device 10, according to a preferred embodiment of the present invention.
Figure 6B:
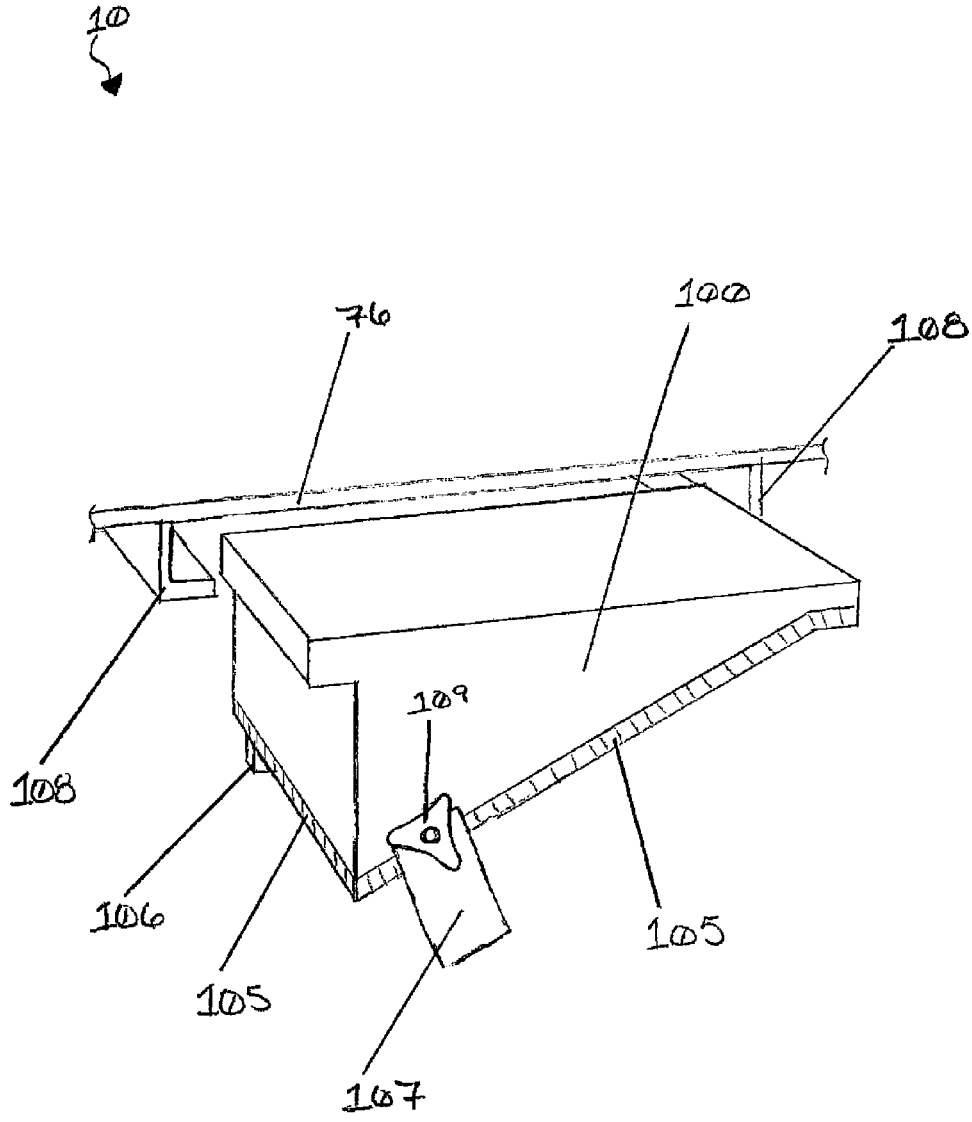
FIG. 6*b* is a close-up perspective view of an attachment means for a footing 100, according to a preferred embodiment of the present invention.
Figure 6C:
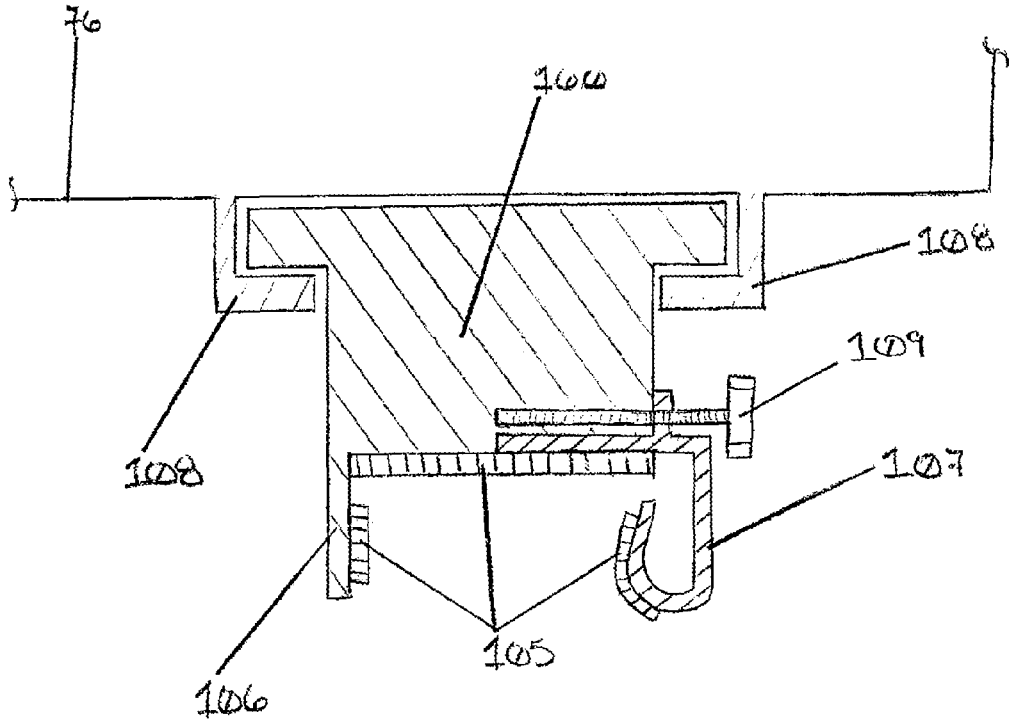
FIG. 6*c* is a section view of the footing 100 taken along section line C-C of FIG. 3, according to a preferred embodiment of the present invention; and, FIG. 7 is a perspective view of the cloth diaper cleaning device 10 depicted in a base 110, according to a preferred embodiment of the present invention.

Referring now to FIG. 6*a*, a rear perspective view of the device 10 and FIG. 6*b*, a close-up perspective view of the attachment means for the footing 100 and FIG. 6*c*, a section view of the footing 100 taken along section line C-C of FIG. 3, according to the preferred embodiment of the present invention, are disclosed. A bottom panel 76 of the device 10 comprises a funnel portion 80 which enables the run-off soiled material to exit the device 10 into the toilet 15 via a funnel opening 85. The funnel portion 80 is located on an intermediate location of the bottom panel 76 of the device 10 and is attached via conventional integral molding techniques. In use, when the device 10 is positioned on the toilet rim 16, the funnel portion 80 is positioned inside of the bowl portion of the toilet 15.

The bottom panel 76 of the device 10 also comprises a pair of footings 100 which angle the device 10 toward the tank portion of the toilet 15. Each footing 100 is slightly inclined to slant the device 10 which enables the water from the spraying and cleaning process to descend into the toilet 15 for conventional flushing. Each footing 100 comprises an anti-skid means 105 on a bottom surface, thereby prohibiting the device 10 from toppling off the toilet rim 16 while in use. The anti-skid means 105 creates friction between the device 10 and the toilet rim 16 and preferably comprises a rubber coating, but other materials and coatings may be incorporated without limiting the scope of the device 10. Each footing 100 also comprises a wall portion 106 and a clip 107 located on opposing sides surfaces of the footing 100 for stabilizing the device 10 on the toilet rim 16. The wall 106 and clip 107 each comprise the anti-skid means 105 on inner surfaces thereof, thereby creating friction between the wall 106 or clip 107 and the toilet rim 16. The wall 106 is an integrally molded downward extension of the footing 100. In use, the wall 106 is positioned against an inner side surface of the toilet rim 16. The clip 107 is attached to a side surface of the footing 100 opposing the wall 106 via a clip fastener 109 which comprises a threaded knob, yet other fastening means may be utilized without limiting the scope of the device 10. The clip 107 is horizontally adjustable, thereby enabling a universal fitting means to various toilet rims 16. In use, the clip 107 is positioned against an outer side surface of the toilet rim 16 at a desired width to engage the toilet rim 16. The user loosens the clip fastener 109 to move the clip 107 inwardly or outwardly to a desired width to engage the toilet rim 16 and then tightens the clip fastener 109 to secure the clip 107 into position. The clip 107 is preferably a conventional compression clip comprising a substantially "U"-shape further comprising a free end and an attached end attached to the side surface of the footing 100 and is positioned at a lower side surface thereof. As the retaining and receiving portion of the device 10 is placed on the toilet rim 16 the free end deflects toward the affixed end placing a compressive friction force upon the rim 16. The clip 107 is fabricated from materials such as, but not limited to: plastic, metal, or the like.

Each footing 100 is removably adjustable to the bottom panel 76 of the device 10 via a pair of tracks 108. Each track 108 is "L"-shaped and integrally molded to the bottom panel 76, thereby enabling a user to adjust each footing 100 to correspond to various toilet 15 dimensions. The tracks 108 are spaced apart from each other at a width identical to the width of the footing 100, thereby enabling insertion therein. Each footing 100 comprises a "T"-shaped upper portion which slidably engages the track 108 to a desired position.

Figure 7:
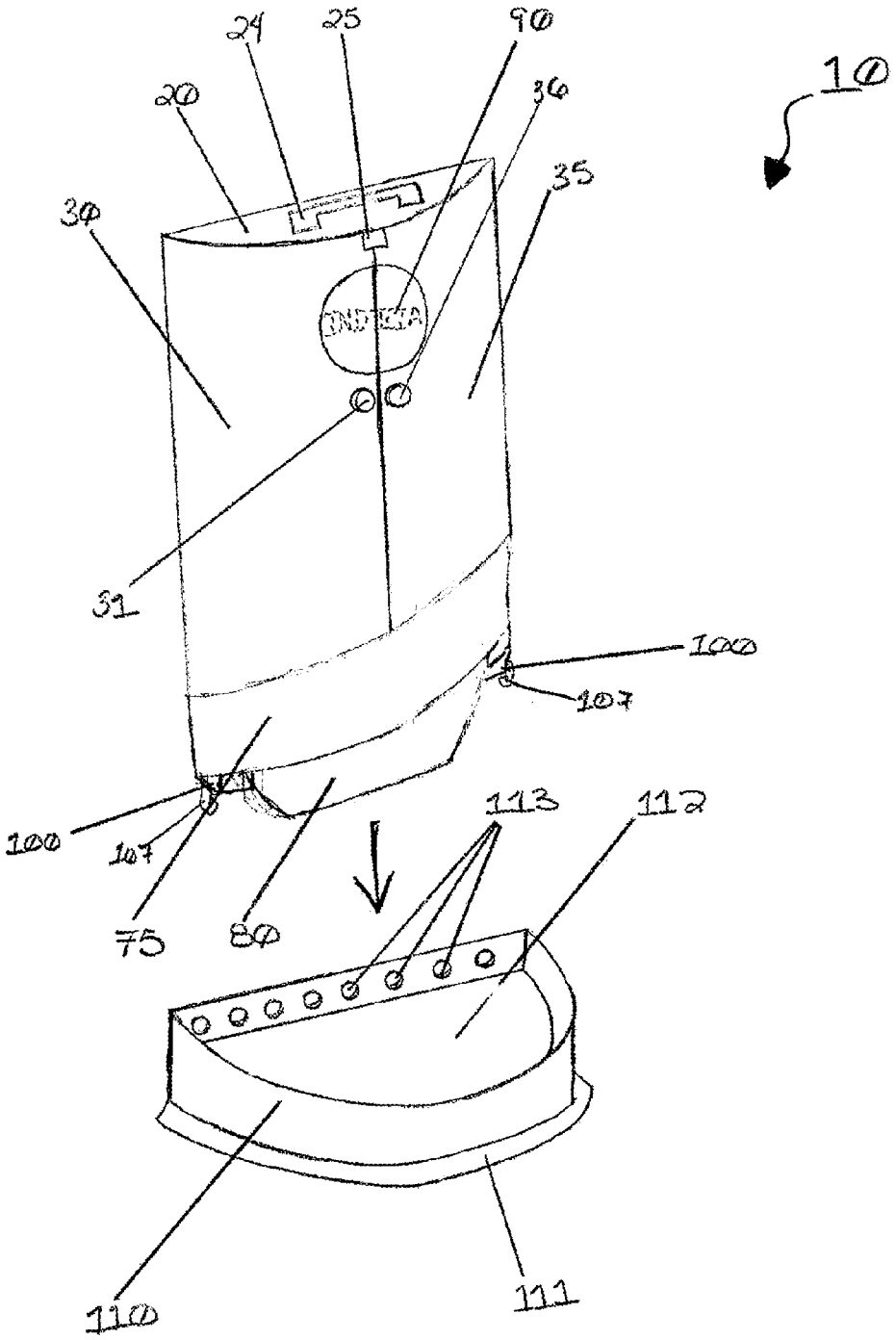

Referring now to FIG. 7, a perspective view of the device 10 depicting placement in a base 110, according to the preferred embodiment of the present invention, is disclosed. The device 10 comprises a base 110 for providing a stabilizing means and storage means to the device 10 when not in use. The base 110 comprises a semi-circular shape which mimics the shape of the device 10, thereby enabling an interference fit within a base interior portion 112. The base 110 comprises a base footing 111 which encompasses an outer perimeter thereof, providing a stabilizing means. The base 110 also comprises a plurality of apertures 113 on a rear surface for providing a ventilation means to the base 110 for drying of the device 10 after use. The base 110 is fabricated from materials such as, but not limited to: plastic, metal, or the like and is available in a variety of colors and patterns that which correspond to the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 7.

The method of installing and utilizing the device 10 may be achieved by performing the following steps: acquiring the device 10; removing the device 10 from the base 110 by lifting the device 10 via the handle 24 in an upward direction; positioning the bottom panel 76 on the toilet rim 16 with the each footing 100 parallel to the toilet rim 16 and with the wall 106 positioned against the inner side surface of the toilet rim 16 and the clip 107 positioned against the outer side surface of the toilet rim 16, thereby angling the device 10; adjusting the clip 107 via the clip fastener 109 to a desired position; lifting the lid 20 upwardly, thereby releasing the lid fastener 25 from the panel fasteners 32, 37 and pivoting the lid hinges 22; opening the side panels 30, 35 by grasping each corresponding panel handle 31, 36 and pivoting the panel hinges 38; attaching a soiled diaper 17 on the intermediate portion 40 by fastening each corner of the soiled diaper 17 to a corresponding clip 50, 55, 60, 65; repositioning each clip 50, 55, 60, 65 to a desired position to pull the diaper 17 taut by moving each clip 50, 55, 60, 65 in a corresponding groove 51, 56, 61, 66 with the ball joint 67 engaged within the secondary channel 57; depressing the second actuator 72 toward the first actuator 71 to open the jaws 69, 70 and pivoting the clip hinge 68; positioning a desired corner of the soiled diaper between the jaws 69, 70 and releasing the actuators 71, 72, thereby closing the jaws 69, 70; repeating the abovementioned clipping process for each desired corner of the soiled diaper 17, thereby suspending the diaper 17 against the base panel 40; spraying or cleaning the soiled diaper 17 in a conventional manner and enabling the run-off to exit the device 10 by traveling downwardly through the funnel 80 and into the toilet 15 via the funnel opening 85; removing the diaper 17 from the device 10 by unfastening from the clips 50, 55, 60, 65; cleaning the interior portion of the device 10; repeating the abovementioned processes as necessary; closing the side panels 30, and lid 20 when cleaning is complete; positioning the device 10 into the base 110; utilizing the device 10 as necessary; and, thoroughly cleaning soiled cloth diapers in a manner which is quick, easy and effective.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A diaper cleaning device comprising:

a generally flat base panel for supporting a soiled diaper in a generally vertical and outstretched configuration, said base panel comprising an upper edge portion, a lower edge portion, and a first side edge portion, and an opposing second side edge portion;

a plurality of spring clips attached to said base panel for securing said soiled diaper in said configuration;

a curved first side panel comprising a first hinged end hingedly attached to said base panel first side edge portion for shielding an over spray of water;

a curved second side panel comprising a second hinged end hingedly attached to said base panel second side edge portion for shielding said over spray of water;

a semi-circular lid hingedly attached to said base panel upper edge portion;

a generally flat bottom panel perpendicularly affixed to said base panel lower edge portion;

a semi-circular lower portion affixed to a lower end of said base panel and a perimeter of said bottom panel, said base panel lower end, said lower portion, and said bottom panel defining a receptacle for collecting an amount of waste water;

a funnel disposed at an intermediate location on said bottom panel for channeling said waste water into a toilet; and, a pair of footings adjustably attached to a bottom surface of said bottom panel for bracing said device to a toilet rim, said at least two footings each further comprising a foot body and a clamping means for clamping said foot body to said toilet rim;

wherein said device further comprises an open state wherein said pair of side panels and said lid are in a hingedly open position for use of said device;

wherein said device further comprises a closed state wherein said pair of side panels and said lid are in a hingedly closed position for storage of said device; and, wherein said first side panel and said second side panel each further comprise a length extending from said base panel upper edge portion to an upper edge portion of said lower portion and an arcuate width such that opposing side edges meet when in said closed state forming a contiguous arc substantially equivalent to said lower portion.

2. The device of claim 1, wherein each of said plurality of spring clips further comprises a pair of lever arms pivotable about a spring biased clip hinge, each of said pair of lever arms further comprising a jaw end and an actuator end opposite said jaw end; whereby said jaw ends are urged closed by said clip hinge and are opened by squeezing together said actuator ends; and, wherein one of said pair of lever arms further comprises a clip post affixed to said actuator end and a ball joint affixed to said clip post opposite said pair of lever arms, said clip post and ball joint being adjustably attached to a front surface of said base panel.

3. The device of claim 2, wherein said base panel front surface further comprises an inlaid groove disposed adjacent to each corner region of said base panel, said groove having at least one linear section and an internal secondary channel for receiving said clip post and said ball joint; and, wherein said clip post and ball joint are slidable within said groove and said secondary channel and is retained at a selectable horizontal and vertical position on said base panel front surface.

4. The device of claim 3, wherein said bottom panel bottom surface further comprises at least two sets of opposing L-shaped brackets, each said set of brackets adjustably attaches one of said pair of footings at a selectable position upon said bottom panel.

5. The device of claim 4, wherein said foot body further comprises a generally T-shaped member further comprising:

a bottom side angled from front to rear for resting upon said toilet rim, whereby said bottom side biases an upper end of said device toward a toilet tank; and, a top end slidably attached within said set of L-shaped brackets;

wherein said angled bottom end further comprises a high-friction surface for contact with said toilet rim.

6. The device of claim 5, wherein said clamping means further comprises:

a vertical bracing wall extending downward from a side of said foot body; and, an adjustable clip extending downward from an opposing side of said foot body;

wherein said clip is threadingly attached to said opposing side for providing an adjustable means of horizontal positioning, whereby said toilet rim is retained between said clip and said bracing wall; and, wherein an inner surface of said bracing wall and said clip further comprises said high-friction surface of contact with said toilet rim.

7. The device of claim 6, wherein said device further comprises a fastening means for fastening said device in said closed state, said fastening means comprising:

a lid fastener disposed on a leading edge of said lid;

a first side panel fastener disposed on a front surface upper corner of said first side panel; and, a second side panel fastener disposed on a front surface upper corner of said second side panel;

wherein said lid fastener, said first side panel fastener, and said second side panel fastener align when said device is in said closed state.

8. The device of claim 7, wherein said device further comprises:

a lid handle affixed to a top surface of said lid for hingedly opening and closing said lid;

a first side panel handle affixed to a front surface of said first side panel for hingedly opening and closing said first side panel; and, a second side panel handle affixed to a front surface of said second side panel for hingedly opening and closing said second side panel.

9. The device of claim 8, wherein said device further comprises a storage base for storing said device when in said closed state, said storage base further comprising:

planar base member for being set on a flat surface;

a semi-circular side wall and a flat rear wall perpendicularly affixed to said base member defining a base interior; and, a plurality of drying apertures disposed in said rear wall;

wherein a lower end of said device is received by said base interior.

* * * * *